United States Patent [19]

Chapman

[11] Patent Number: 4,516,365

[45] Date of Patent: May 14, 1985

[54] SUPPORT ASSEMBLY AND METHOD

[76] Inventor: Nicholas J. Chapman, 40587 Robin St., Fremont, Calif. 94538

[21] Appl. No.: 441,050

[22] Filed: Nov. 12, 1982

[51] Int. Cl.[3] ..... E02D 27/42

[52] U.S. Cl. ..... 52/170; 52/514; 52/742

[58] Field of Search ..... 52/170, 165, 296, 166, 52/155, 742, 514, 704, 153, 154; 405/216

[56] References Cited

U.S. PATENT DOCUMENTS

| | | | |
|---|---|---|---|
| 94,195 | 8/1869 | Fisher | 52/153 |
| 106,375 | 8/1870 | Larkin | 52/153 |
| 284,219 | 9/1883 | Mehew | 52/154 |
| 405,658 | 6/1889 | Campany | 52/170 |
| 907,817 | 12/1908 | Knoerzer | 52/153 |
| 1,553,785 | 9/1925 | Ley . | |
| 1,706,684 | 3/1929 | Welsz | 52/153 |
| 1,784,770 | 12/1930 | Wiley | 20/100 |
| 1,950,677 | 3/1934 | Hogan | 20/100 |
| 2,897,553 | 8/1959 | Gorrow | 20/100 |

FOREIGN PATENT DOCUMENTS 29110 10/1844 Fed. Rep. of Germany .

*Primary Examiner*—Henry E. Raduazo
*Assistant Examiner*—Naoko N. Slack
*Attorney, Agent, or Firm*—Willis E. Higgins

[57] ABSTRACT

An assembly (10) for supporting a post (12) with respect to an aperture (14) in concrete (16) includes first and second opposed surfaces (32). Each of the surfaces (32) has one end shaped to fixedly engage an end of the post (12). Each of the surfaces (32) has a second end extending longitudinally beyond the end of the post (12). The extending ends of the surfaces (32) are configured to enter the aperture (14) and have opposed camming shapes (38 and 44) which wedge the extending ends of surfaces (32) into tight engagement with the aperture (14) as the extending ends move further into the aperture (14). The method includes providing such an assembly, driving the assembly to position one end of the surfaces (32) against the post (12) and the extending end into aperture (14), so that the camming surfaces (38 and 44) push the extending end of the surfaces (32) against the aperture (14). The surfaces (32) are then fixedly attached to opposing sides (24 and 26) of the post (12) by screws (22).

17 Claims, 12 Drawing Figures

SUPPORT ASSEMBLY AND METHOD

BACKGROUND OF THE INVENTION

1. Field of the Invention

This invention relates to an improved assembly and method for fixedly attaching a structural member with respect to an apertured support. More particularly, it relates to such an assembly and method which is especially adapted for use in repairing otherwise structurally sound wood fences having fenceposts originally set in concrete that have rotted below ground level.

2. Description of the Prior Art

Wooden posts used in fences and similar posts set in concrete in the ground are prone to rotting beneath the ground. In the past, it has been a common practice to replace an otherwise structurally sound fence entirely when the posts that have rotted below ground level will no longer support the fence. Such a procedure is both expensive and requires a substantial amount of labor.

While a wide variety of techniques have been proposed and utilized in the prior art for attaching structural and similar members to their supports, none of the prior art techniques are suitable for solving the problem of otherwise structurally sound fenceposts. Examples of the prior art techniques are disclosed in U. S. Pat. Nos. 2,062,686; 3,312,034; 3,378,971; 3,703,812; and 3,935,685. Thus, a need remains for further development of such assemblies and methods.

SUMMARY OF THE INVENTION

Accordingly, it is an object of this invention to provide an assembly and method for fixedly attaching a structural member with respect to an apertured support.

It is another object of the invention to provide such an apparatus and method especially adapted for easy repair of an otherwise structurally sound fence which has posts originally set in concrete that have rotted below ground level.

It is still another object of the invention to provide such an assembly for use by driving into the aperture of the support which is foolproof in use.

It is a still further object of the invention to provide such an assembly which is useful with different sized structural members.

The attainment of these and related objects may be achieved through use of the novel assembly and method for fixedly supporting a structural member with respect to an aperture herein disclosed. The assembly includes a first and a second opposed surface. Each of the surfaces has one end shaped to fixedly engage an end of the structural member. Each of the assembly surfaces has a second end extending longitudinally beyond the end of the structural member. The second assembly surface ends are configured to enter the aperture and have opposed camming shapes which wedge the second surface ends into tight engagement with the aperture as the second assembly surface ends move further into the aperture.

The method of this invention for fixedly attaching a structural member to an aperture includes providing an attaching assembly with the first end configured to be driven into the aperture and expand into tight engagement with the aperture and a second end configured for fixed attachment to the structural member. The first end of the attaching assembly is driven into the aperture.

The second end of the attaching assembly is fixedly attached to the structural member.

In the preferred form of the invention, the structural member is a fencepost and the aperture is formed in concrete beneath the fencepost. The assembly can either be used at the time of initial construction of the fence by pouring the concrete around the second assembly surface ends, or the assembly can be used to renovate an existing fence when rotting of the fencepost ends embedded in concrete occurs.

In the preferred use of the invention, the fencepost is supported above ground level, so that the tendency of the fencepost to rot is substantially reduced or eliminated. While the features of the present assembly and method make it especially adapted for use with fenceposts, the ease of installation of this assembly and practice of this method should make it applicable to a wide variety of other applications as well, such as in tilt-up construction assemblies, in which beams are fixedly attached to a concrete wall or similar structure.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figures 1A, 1B:
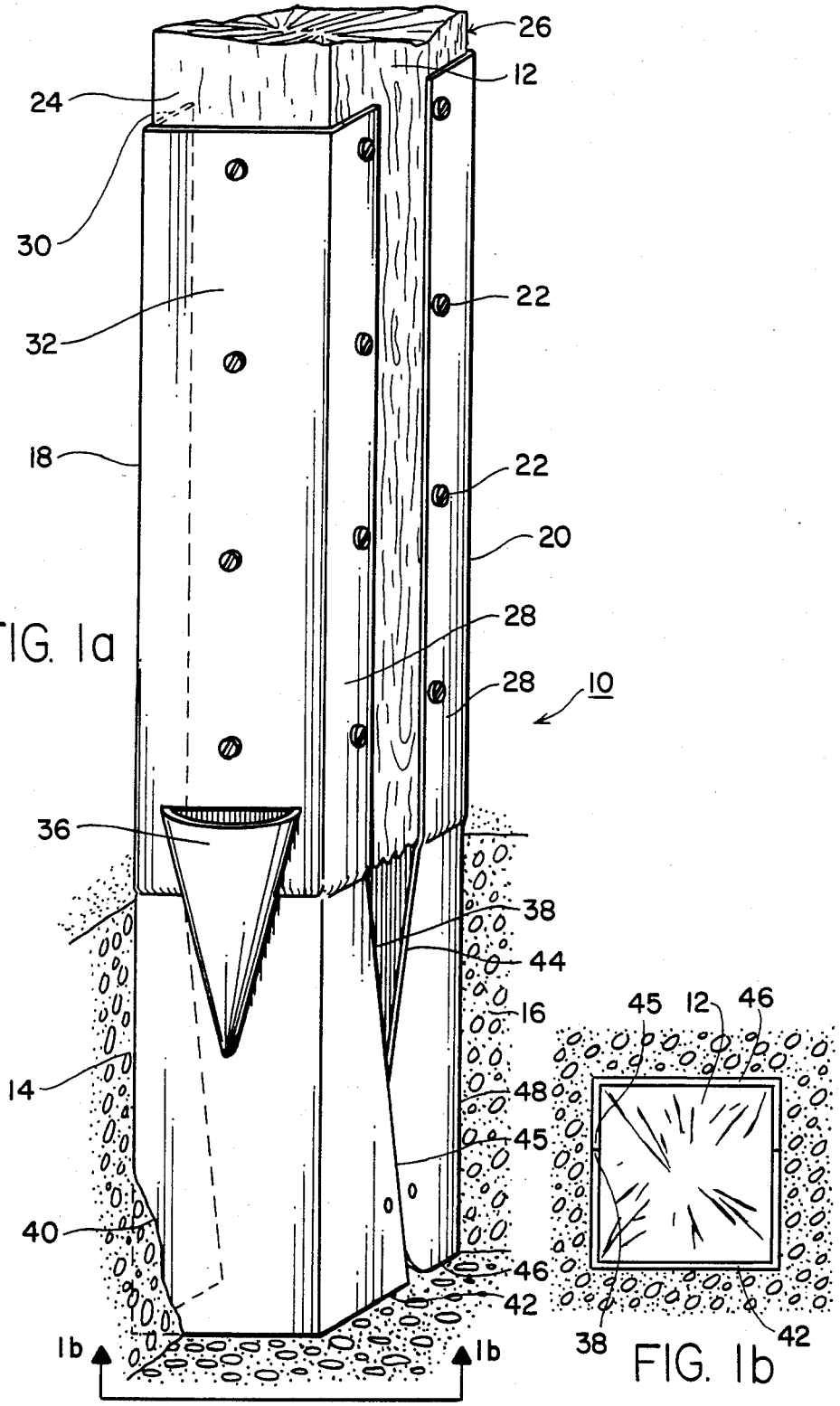
FIG. 1*a* is a perspective view of the invention as installed.
FIG. 1*b* is a bottom view of the invention as shown in FIG. 1*a*, taken from line 1*b*—1*b* in FIG. 1*a*.

Turning now to the drawings, more particularly to FIGS. 1*a*–3, there is shown an assembly 10 for fixedly supporting post 12 with respect to aperture 14 in concrete 16, below post 12. The assembly 10 includes first and second brackets 18 and 20, fixedly attached by screws 22 or other suitable fastener on opposing sides 24 and 26 of fencepost 12.

Each of the brackets 18 and 20 of the assembly 10 is formed from first and second sides 28 and 30, joined together by a third side 32. The sides 28, 30, and 32 have holes 34 for receiving the screws 22 to attach the brackets 18 and 20 to the opposing sides 24 and 26 of the fencepost 12. A driving portion 36 extends from each side 32 of the brackets 18 and 20, so that the brackets 18 and 20 may be placed on the sides 22 and 24 of the post 12 and driven into aperture 14 by impacting the driving portion 36 with a suitable driving tool. Since driving portion 36 partially enters aperture 14 as shown in FIG. 1*a*, a wedging action against the sides 40 of aperture 14 occurs, serving to help maintain brackets 18 and 20 in place. The bracket 18 has an angled camming edge 38 on each of its sides 28 and 30. As shown, the camming edges 38 extend along sides 40 of the aperture 14, toward the center of each side 40 toward the distal end 42 of the bracket 18.

Opposing bracket 20 has a similar edge 44 on its sides 28 and 30. However, the angled edge 44 extends toward the center of sides 40 of aperture 14 only part of the way toward distal end 46 of the bracket 20. The edge 44 then is angled back at 45 toward edges 48 of the sides 40 to the distal end 46 of bracket 20. The remaining portion 45 of edge 44 is thus substantially parallel to camming edge 38 when the brackets 18 and 20 are installed, as shown in FIG. 1. As can best be appreciated from FIG. 1*a*, the camming edges 38 and 45 interact when the brackets 18 and 20 are driven into aperture 14, so that brackets 18 and 20 become wedged into the aperture 14. The camming portion 45 of edges 44 nearest to distal end 46 of bracket 20 interacts with the opposing camming edges 38 on brackets 18 to prevent either bracket 18 or 20 from being withdrawn from aperture 14 when the brackets are screwed to post 12.

Figure 4A:
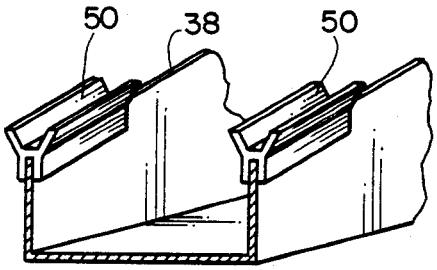
FIGS. 4*a*, 4*b*, 4*d*, and 4*e* perspective views of portions of different embodiments of the invention drawn from a line corresponding to line 4—4 in FIG. 2.

FIGS. 4*a* through 4*e* show various modified forms of the brackets 18 and 20, all of which operate in the same basic manner as the brackets 18 and 20 shown in FIGS. 1*a*–3. In FIG. 4*a*, a plastic or other suitable resilient material insert 50 is placed over camming edges 38. The insert 50 provides a wider camming surface than the camming edges 38, to assure that the camming edges 38 or 45 will not slip inside one another when the brackets 18 and 20 are driven into the aperture 14. The insert 50 also acts as a rust inhibitor, since it prevents the camming edges 38 and 45 from scraping paint or other coating from each other during the driving operation.

Figure 4B:
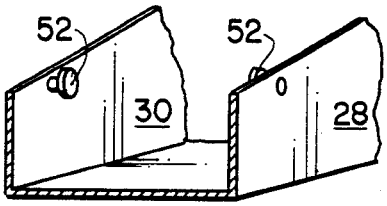
Figure 4C:
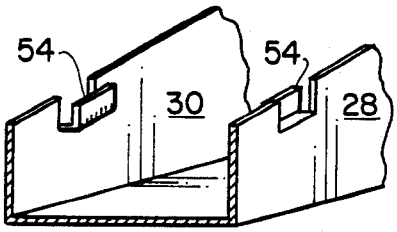
Figure 4D:
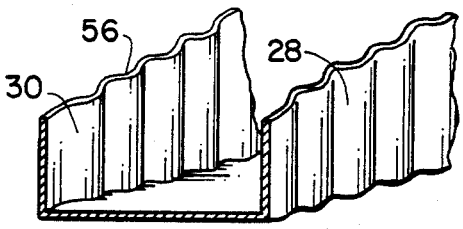
Figure 4E:
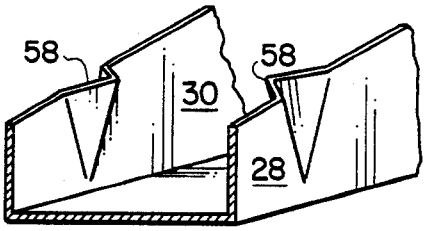

In the embodiment of FIG. 4*b*, rivets 52 are placed into each side 28 and 30 of the brackets 18 and 20 to provide a similar widening of the camming edges 38 and 45. Only the bracket 18 is shown in FIG. 4*b*, but the rivets 52 are also placed on the sides 28 and 30 of the bracket 20. In FIG. 4*c*, the widening effect is achieved by stamping out one or more detents 54 in each side 28 and 30 of the brackets 18 and 20. In FIG. 4*d*, the sides 28 and 30 are corrugated as shown at 56 as another way to prevent slippage of the camming edges 38 and 45 from one another. In FIG. 4*e*, bending the sides 28 and 30, as at 58, achieves the same result as the corrugations 56.

Figure 2:
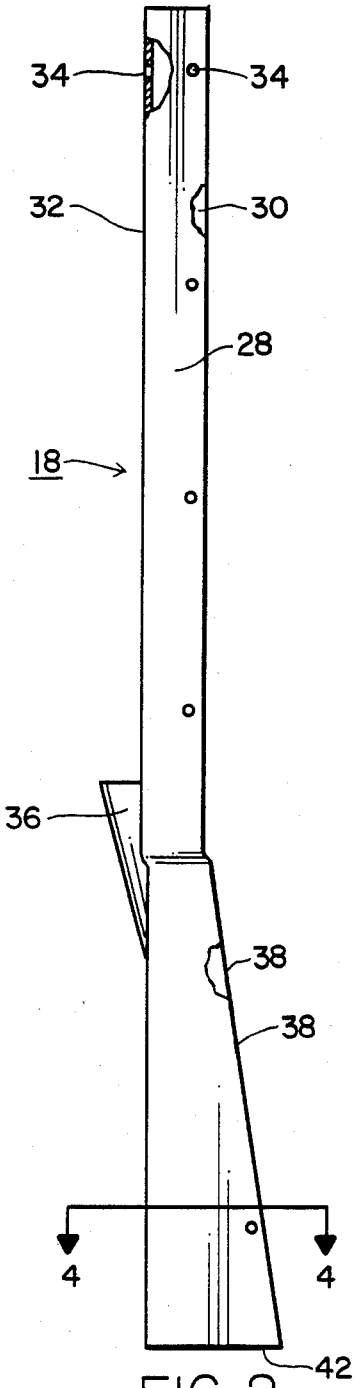
FIG. 2 is a side view of a first portion of the invention.
Figure 3:
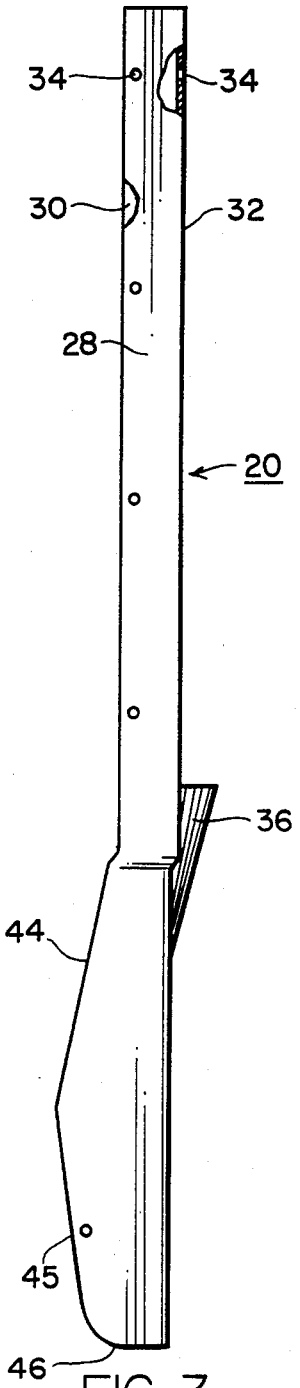
FIG. 3 is a side view of a second portion of the invention.
Figure 5:
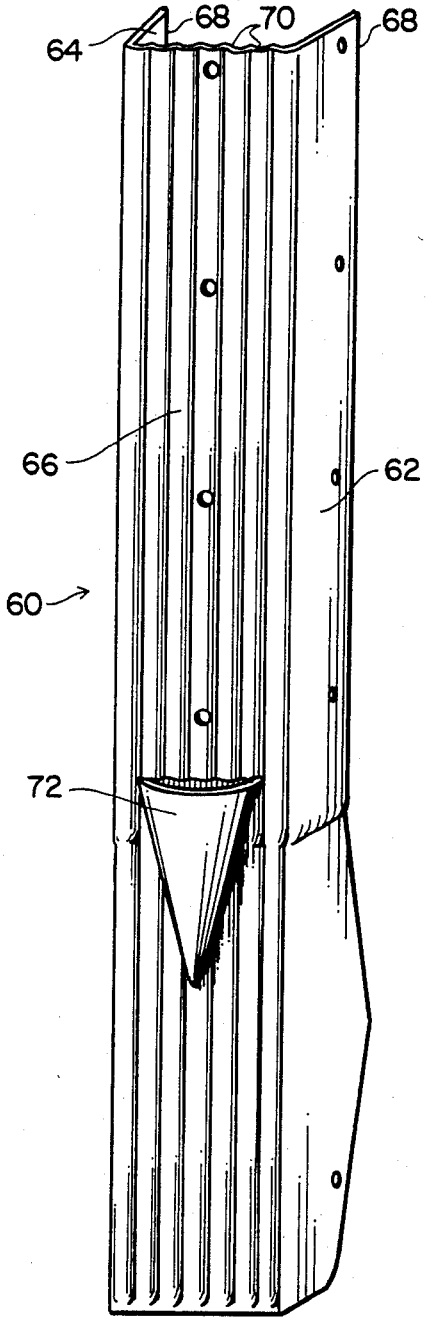
FIG. 5 is a perspective view of another embodiment of the invention.

FIG. 5 shows another embodiment of a bracket 60 that may be used with different size fenceposts. The bracket 60 has first and second sides 62 and 64, each of which sides 62 and 64 flare outward slightly from third side 66 joining the first and second side 62 and 64. For example, if side 66 is 3.5 inches in width, sides 62 and 64 flare outward, so that their edges 68 are 4 inches apart. Side 66 is corrugated, as indicated at 70. In other respects, the bracket 60 shown in FIG. 5 is identical to the bracket 20 shown in FIGS. 1 and 3. A corresponding opposing bracket for the bracket 60, otherwise identical with the bracket 18 shown in FIGS. 1*a* and 2, is provided for use with the bracket 60.

In use of the bracket 60 shown in FIG. 5, portion 72 of the bracket 60 is used to pound the bracket 60 over a post 12 and into aperture 14 in the same manner as with the FIG. 1*a*–3 embodiment. When used with a 4 inch square post, the side 66 of bracket 60 will expand by straightening out the corrugations 70 so that. the bracket 60 will conform to the 4 inch post. The 4 inch dimension is conventionally employed for roughcut fenceposts. In use with $3\frac{1}{2}$ inch posts, conventionally used as smooth finished fenceposts, sides 62 and 64 of the bracket 60 will bend to assume 90 degree angles with respect to the side 66. Any of the embodiments of FIGS. 4*a* through 4*e* can also be employed with the bracket 60 shown in FIG. 5.

Figure 6A:
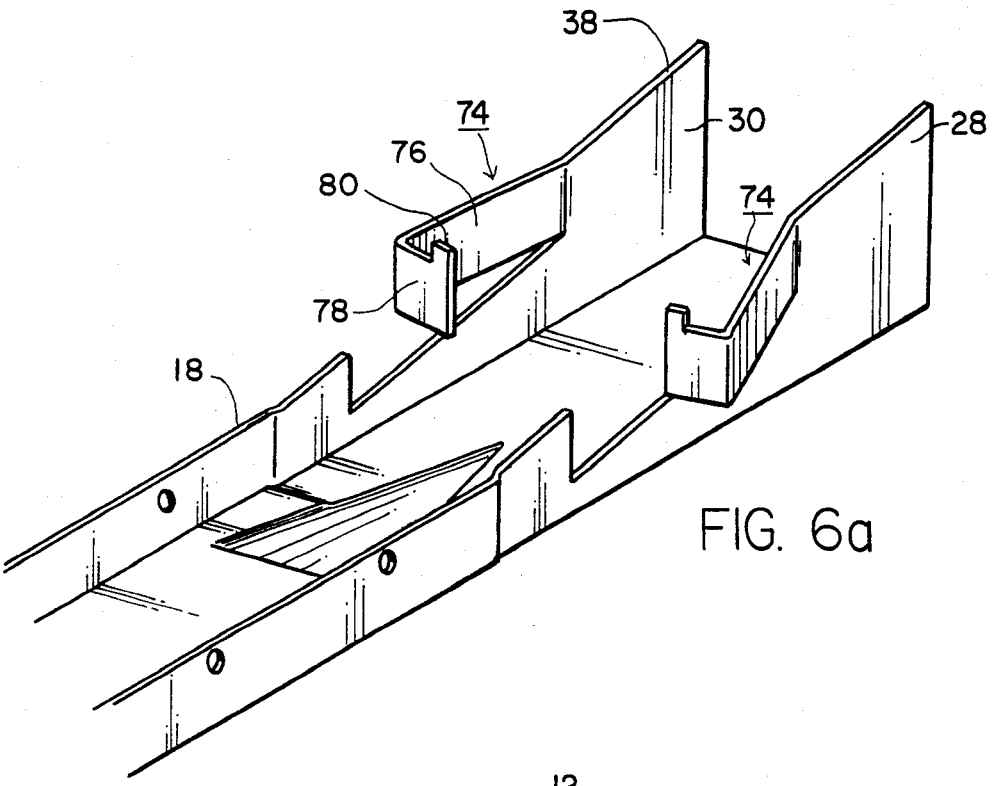
FIG. 6*a* is a perspective view of another embodiment of the invention.
Figure 6B:
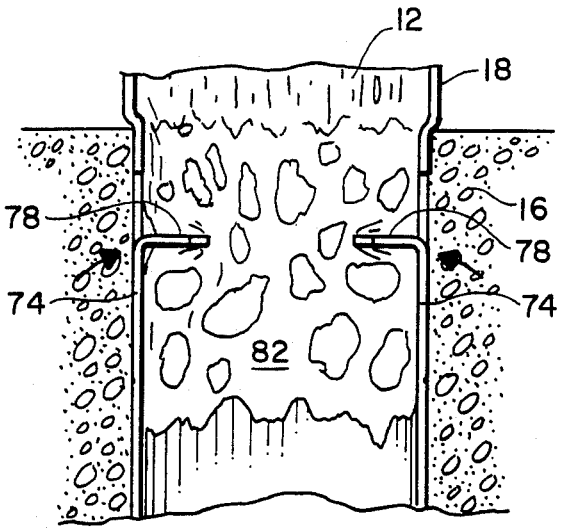
FIG. 6*b* is a cross-section view of a portion of the embodiment of FIG. 6*a* as installed.

FIGS. 6*a* and 6*b* show another bracket 18 in which projections 74 extend outward from the sides 28 and 30 of the bracket prior to installation. The projections 74 are pushed inside bracket 18 to the position shown in FIG. 6*b* when the bracket 18 is installed in concrete 16. Sides 78 of the projections 74 dig into rotted portion 82 of post 12 after the projections 74 are within the concrete 16. However, with the position shown in FIG. 6*a*, the projections 74 do not engage the sound portion of post 12 above ground during installation.

In addition to being utilized for repair of otherwise sound wooden fences with posts 12 that have rotted below ground level, the assembly of this invention can also be used for new fence installations, by casting the brackets 18 and 20 with camming edges 38 and 44 imbedded in the concrete 16, then attaching the fencepost 12 to the brackets 18 and 20, thus giving the structure shown in FIG. 1*a*.

It should now be apparent to those skilled in the art that an assembly and method for fixedly supporting a structural member with respect to an aperture has been provided. The assembly and method of this invention allows convenient and labor saving replacement of fenceposts with rotted ends below ground in an otherwise sound wooden fence. The configuration and ease of use of the present assembly and method should make it similarly useful in a wide variety of other applications for supporting a structural member with respect to an aperture.

It should further be apparent to those skilled in the art that various changes in form and details of the invention as shown and described may be made. It is intended that such changes be included within the spirit and scope of the claims appended hereto.

What is claimed is:

1. An assembly for fixedly supporting a structural member with respect to an aperture, said assembly having a first and a second opposed surface, each of said surfaces having one end shaped to fixedly engage an end of the structural member, each of said assembly surfaces having a second end extending longitudinally beyond the end of the structural member, said second assembly surface ends being configured to enter the aperture and having opposed camming shapes which wedge said second surface ends into tight engagement with the aperture as said second assembly surface ends move further into the aperture, said opposed camming shapes being angular and extending toward one another at sides of said assembly, one of said camming shapes extending toward the opposing camming shape to a point short of a distal end of said one camming shape and then extending substantially parallel to the opposing camming shape toward the distal end.

2. The assembly of claim 1 in which said first and second opposed surfaces are each a part of opposed brackets shaped to engage the end of the structural member.

3. The assembly of claim 2 in which the brackets are channel shaped and said assembly includes means for fastening the brackets to the structural member.

4. The assembly of claim 2 in which said assembly second ends are channel shaped.

5. The assembly of claim 4 in which the camming surfaces of said assembly second ends include a width defining portion for maintaining the camming surfaces in engagement inside the aperture.

6. The assembly of claim 1 in which said brackets include first and second sides joined together by an expandable portion and said first and second sides flare outward from said expandable portion, said assembly being usable with structural members of different sizes.

7. The assembly of claim 1 additionally comprising a driving force portion shaped to be impacted by a driving tool for moving the second end of said assembly into the aperture.

8. The assembly of claim 1 in which said structural member is a fencepost.

9. The assembly of claim 8 in which the aperture is formed in concrete below the fencepost.

10. A method for fixedly attaching a structural member to an aperture, which comprises providing an attaching assembly comprising first and second brackets, each with a first end having camming surfaces configured to be driven into the aperture and engage the camming surfaces of the other bracket so that the assembly will expand into tight engagement with the aperture and a second end configured for fixed attachment to the structural member, positioning the first and second brackets on the structural member in opposed relationship, driving the first ends of the opposed brackets into the aperture, and fixedly attaching the second ends of the brackets to the structural member.

11. The method of claim 10 in which the structural member is a fencepost and the aperture is fixed in concrete beneath the fencepost.

12. A method for repairing a post originally set in concrete and which has rotted below ground level, which comprises providing an attaching assembly comprising first and second brackets, each with a first end having camming surfaces configured to be driven into an aperture in the concrete originally formed around the post and expand the assembly into tight engagement with the aperture, and a second end configured for attachment to the post above ground level, positioning the first and second brackets in opposed relationship around the post, driving the first ends of the opposed brackets into the aperture, and fixedly attaching the second ends to the post.

13. An assembly for fixedly supporting a structural member with respect to an aperture, said assembly comprising first and second brackets respectively having a first and a second opposed surface, each of said surfaces having one end shaped to fixedly engage an end of the structural member, each of said assembly surfaces having a second end extending longitudinally beyond the end of the structural member, said second assembly surface ends being configured to enter the aperture and having opposed camming shapes which wedge said second surface ends into tight engagement with the aperture as said second assembly surface ends move further into the aperture, said first and second brackets each having first and second sides joined together by an expandable portion, said first and second sides flaring outward from said expandable portion, said assembly being usable with structural members of different sizes.

14. The assembly of claim 13 in which said expandable portion is a corrugated third side extending between said first and second sides.

15. The assembly of claim 13 in which said opposed camming shapes are angular and extend toward one another at sides of said assembly, one of said camming shapes extending toward the opposing camming shape to a point short of a distal end of said one camming shape and then extending substantially parallel to the opposing camming shape toward the distal end.

16. An assembly for fixedly supporting a structural member with respect to an aperture, said assembly comprising first and second opposed brackets respectively having a first and a second opposed surface, each of said surfaces having one end shaped to fixedly engage an end of the structural member, each of said surfaces having a second end extending longitudinally beyond the end of the structural member, said second assembly surface ends being configured to enter the aperture and having opposed camming shapes which wedge said second surface ends into tight engagement with the aperture as said second assembling surface ends move further into the aperture, each of said opposed brackets having a plurality of corrugations extending longitudinally along said brackets, said corrugations allowing said brackets to expand so that said assembly is usable with structural members of different sizes.

17. The assembly of claim 16 in which the first and second opposed surfaces are on first and second sides of each bracket and the corrugations are on a third side extending between the first and second sides.

* * * * *